United States Patent [19]

Theurer et al.

[11] Patent Number: 4,825,768

[45] Date of Patent: May 2, 1989

[54] MOBILE MACHINE FOR LEVELING, LINING AND TAMPING A TRACK SWITCH

[75] Inventors: Josef Theurer, Vienna; Wilhelm Praschl; Friedrich Peitl, both of Linz, all of Austria

[73] Assignee: Franz Plasser Bahnbaumaschinen-Industriegesellschaft m.b.H., Vienna, Austria

[21] Appl. No.: 210,923

[22] Filed: Jun. 24, 1988

[30] Foreign Application Priority Data

Nov. 5, 1987 [EP] European Pat. Off. ..... 87890247.7

[51] Int. Cl.[4] ..... E01B 27/17

[52] U.S. Cl. ..... 104/7.2; 104/12

[58] Field of Search ..... 104/7.1, 7.2, 10, 12

[56] References Cited

U.S. PATENT DOCUMENTS

| | | | |
|---|---|---|---|
| 3,455,249 | 7/1969 | Stewart | 104/7.1 |
| 4,323,013 | 4/1982 | Theurer | 104/7 B |
| 4,342,263 | 8/1982 | Hurni | 104/7 B |
| 4,625,651 | 12/1986 | Theurer | 104/7.2 |
| 4,627,360 | 12/1986 | Theurer et al. | 104/7.2 |

FOREIGN PATENT DOCUMENTS

| | | |
|---|---|---|
| 2505482 | 8/1976 | Fed. Rep. of Germany . |
| 2140061 | 11/1984 | United Kingdom . |

*Primary Examiner*—Johnny D. Cherry
*Assistant Examiner*—Gary C. Hoge
*Attorney, Agent, or Firm*—Kurt Kelman

[57] ABSTRACT

A mobile machine for leveling, lining and tamping a track switch comprises a machine frame and a track lifting and lining tool carrier frame mounting a pair of flanged lining rollers arranged for supporting the carrier frame on the rails of the main track and for lining engagement with the main track rails, lifting tools including a respective vertically and laterally adjustable clamping element arranged for clamping engagement with the main track rails, and lifting and lining power drives connecting the carrier frame to the machine frame for vertically and laterally adjusting the carrier frame with respect to the machine frame. The machine has a branch track lifting device comprising a laterally adjustable carrier frame, flanged rollers arranged for supporting the carrier frame on one of the rails of the branch track, and a laterally adjustable clamping element including at least one lifting roller arranged on the carrier frame for clamping engagement with the one branch track rail.

15 Claims, 2 Drawing Sheets

MOBILE MACHINE FOR LEVELING, LINING AND TAMPING A TRACK SWITCH

BACKGROUND OF THE INVENTION (1) Field of the Invention

The present invention relates to a mobile machine for leveling, lining and tamping a track switch comprising a main track and a branch track laterally adjacent the main track resting on ballast, each track consisting of two rails fastened to successive ties, which comprises a machine frame supported on undercarriages for movement along the main track in an operating direction, a track lifting and lining tool carrier frame mounting lining tools including a pair of flanged lining rollers arranged for supporting the carrier frame on the rails of the main track and for lining engagement with the main track rails, and lifting tools including a respective vertically and laterally adjustable clamping element, such as a rail-engaging hook and/or roller, arranged for clamping engagement with the main track rails, and lifting and lining power drive means connecting the carrier frame to the machine frame for vertically and laterally adjusting the carrier frame with respect to the machine frame.

(2) Description of the Prior Art

U.S. Pat. No. 4,627,360, dated Dec. 9, 1986, discloses such a machine whose track tamping, lifting and lining units are specifically designed for operation in track switch sections. The transversely displaceable track tamping units have, per track rail, two or four reciprocatory tamping tools at the field and gage sides of each rail and the tamping tools are independently adjustable in the direction of elongation of the ties. This arrangement enables tie tamping even in the most difficult areas of a switch with at least one of the tamping tools while any of the other tamping tools encountering an obstacle may be adjusted upwardly out of contact with the obstacle. To enable such a track switch, with its long ties and complex rails, to be gripped for leveling and lining, the longitudinally displaceable track lifting and lining unit comprises a strong lifting hook per rail and hydraulic drives for laterally and vertically adjusting each lifting hook. Such lifting hooks are capable of engaging the rails in the most difficult areas either by the rail head or at the rail base. Such switch tampers are very important for a proper maintenance of railroad tracks since the expensive track switch sections require proper positioning and this is assured by suitable leveling and lining reference systems which control the operation of the lifting and lining tools. However, the accuracy of the leveling operation is somewhat impeded because it involves the lifting of the very heavy switch section including the branch track laterally adjacent the main track. For this reason, a controlled leveling operation is often repeated during subsequent surfacing of the branch track during which this correct level is fixed by tamping the ties of the branch track.

U.S. Pat. No. 4,323,013, dated Apr. 6, 1982, discloses a track leveling, lining and tamping machine for use in tangent and switch track sections. The machine comprises a tool carrier frame having a central, forwardly projecting boom linked to the machine frame supported by a pair of flanged wheels on the track rails and mounting, per rail, a pair of lifting rollers and a lifting hook therebetween. Two lifting and two lining drives connect the tool carrier frame to the machine frame. The flanged wheels serve as lining tools. The lifting rollers are laterally pivotal into clamping engagement with the associated rail and each lifting hook is vertically and laterally adjustable for engaging either the rail head or rail base, and these lifting tools cooperate for lifting even very heavy track switches. In a simplified embodiment, only a single lifting roller is arranged for cooperation with the lifting hook at each rail for selectively or together engaging a field side of the associated rail. The flange of the flanged wheel serving as lining tool engages the gage side of the rail so that the same is firmly clamped between the lining tool and the lifting roller and/or hook. In most instances, this arrangement suffices for effectively leveling and lining even the most difficult track switches, and this machine has been very successful in commercial track maintenance and rehabilitation work. However, in this machine, too, the very heavy weight of the adjacent branch track disadvantageously stresses the lifting drives and tools so that the leveling accuracy is impaired. To relieve this heavy load, it has been proposed to mount lifting winches in the range of the branch track for assisting in the raising of the branch track but this requires additional operating personnel and also considerably slows the operation. The lifting winches must be dismounted and remounted again after each intermittent tie tamping cycle, which makes the work very cumbersome and slow.

U.S. Pat. No. 4,342,263, dated Aug. 3, 1982, also discloses a track leveling, lining and tamping machine with a two-part carrier frame for a track lifting and lining assembly, the upper part of the carrier frame having a central, forwardly projecting boom mounted on the machine frame for longitudinal displacement with respect thereto. A pair of flanged rollers supports the lower part of the carrier frame on the track rails. A transversely displaceable, pivotal lifting hook is mounted on the upper carrier frame part in the range of each flanged roller for clamping engagement with the associated rail. A vertical adjustment drive connects the upper carrier frame part to the lower carrier frame part for vertically adjusting the lifting hooks mounted on the upper part. Two lifting and lining drives and a longitudinal displacement drive connect the carrier frame to the machine frame. Since only a single lifting tool is provided for each rail, this machine cannot be used for lifting heavy track sections and it also is incapable of lifting track sections which have obstacles in the way of the lifting tools, such as are encountered in track switches. Obviously, the above-indicated disadvantages in handling the heavy weights of branch tracks in track switches are even more pronounced in the operation of this machine.

A similar track leveling, lining and tamping machine with a pair of flanged lining wheels cooperating with associated lifting hooks or rollers is disclosed in UK patent application No. 2,140,061, published Nov. 21, 1984. In view of the limited number of rail-engaging tools for lifting the track, the machine has the above-indicated disadvantages when working in track switches.

SUMMARY OF THE INVENTION

It is the primary object of this invention to improve a mobile machine of the type described in the introductory paragraph of the specification so that a track switch comprising a main track and a branch track laterally adjacent and connected thereto may be economically and accurately leveled and lined even when this track switch is very heavy.

The above and other objects are accomplished in such a machine by providing a branch track lifting device comprising a carrier frame, flanged rollers arranged for supporting the carrier frame on one of the rails of the branch track, and a laterally adjustable clamping element including at least one lifting roller arranged on the carrier frame for clamping engagement with the one branch track rail, and means for laterally adjusting the carrier frame with respect to the machine frame and the branch track.

With this machine, the branch track connected to the main track by long ties at the switch can be lifted at the same time that the main track is lifted for leveling and tamping. This enhances the accuracy of the track switch level and, at the same time, the branch track lifting device advantageously relieves the main track lifting and lining carrier frame of the asymmetrical stress exerted by the weight of the adjacent branch track. The cooperation of the flanged rollers supporting the carrier frame of the branch track lifting device on one rail and the lifting roller automatically centers the lifting roller with respect to the rail.

BRIEF DESCRIPTION OF THE DRAWING

The above and other objects, advantages and features of the invention will become more apparent from the following detailed description of a now preferred embodiment thereof, taken in conjunction with the accompanying, somewhat schematic drawing wherein.

DETAILED DESCRIPTION OF THE PREFERRED EMBODIMENT

Figure 1:
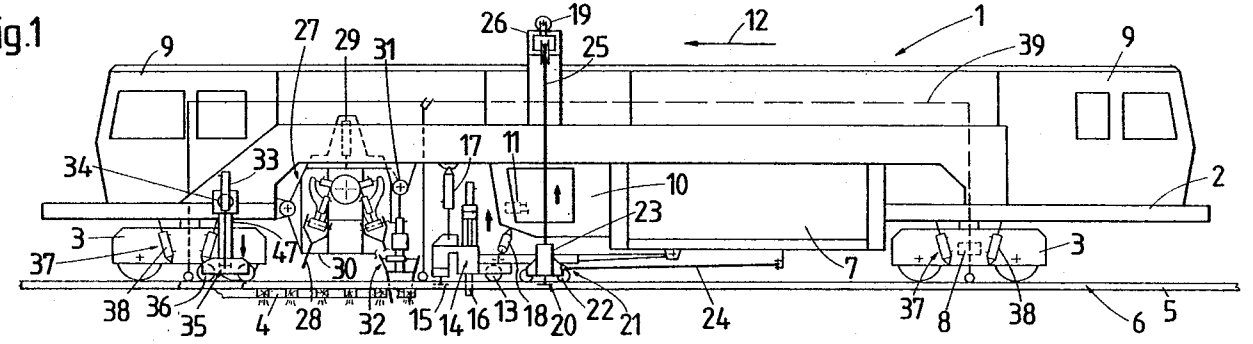
FIG. 1 is a side elevational view of a mobile machine according to the present invention.
Figure 2:
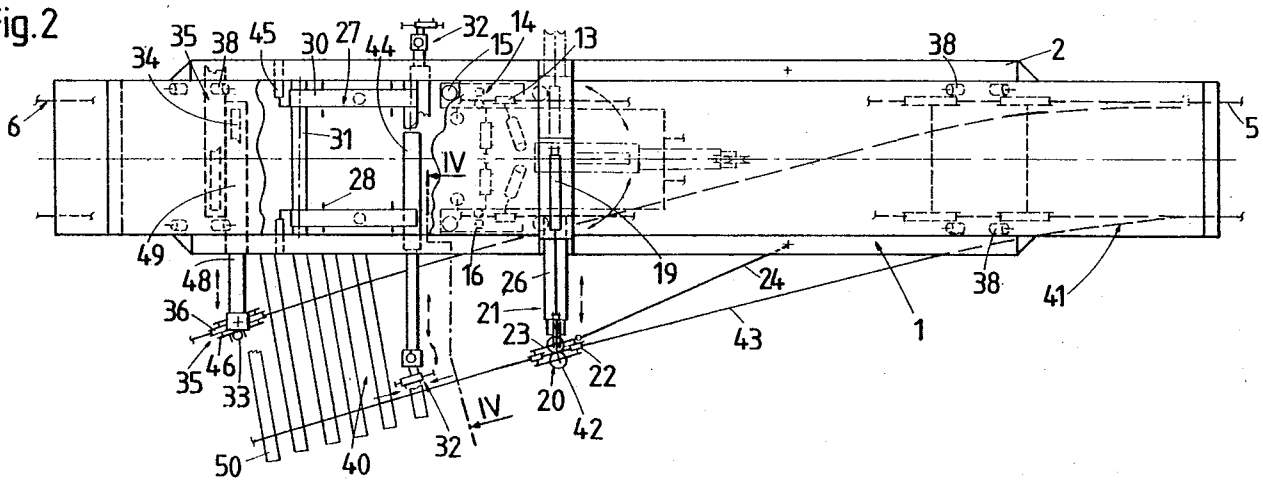
FIG. 2 is a diagrammatic top view of the machine.

Referring now to the drawings and first to FIGS. 1 and 2, there is shown mobile machine 1 for leveling, lining and tamping a track switch comprised of main track 6 consisting of two rails 5 fastened to ties 4 and branch track 40 laterally adjacent the main track and consisting of two rails 43 fastened to ties 50. The tracks rest on ballast (not shown). Machine 1 comprises elongated machine frame 2 supported on undercarriages 3, 3 for movement along main track 6 in an operating direction indicated by arrow 12. The illustrated undercarriages are double-axle swivel trucks, and central power plant 7 is mounted on the machine frame to supply power to all the operating drives of the machine, including drive 8 for moving machine 1 along the track. Respective driver's cabs 9 are mounted at each end of machine frame 2 to enable the machine to be moved in either direction, and operator's cab 10 is mounted on the underside of machine frame 2 between the undercarriages and holds control panel 11 to enable an operator to operate the lifting, lining and tamping tools. Track lifting and lining tool carrier frame 14 is mounted within view of operator's cab 10 and in front thereof in the operating direction, and this carrier frame mounts lining tools including a pair of flanged lining rollers 13 arranged for supporting carrier frame 14 on rails 5 of main track 6 and for lining engagement with the main track rails, and lifting tools including a respective vertically and laterally adjustable clamping element arranged for clamping engagement with main track rails 5. The illustrated lifting tools are laterally pivotal lifting rollers 15 arranged for subtending the rail heads for clamping engagement and transversely as well as vertically displaceable lifting hooks 16 for selectively engaging the rail heads or bases. The rear end of the tool carrier frame 14 is linked to machine frame 2. Lifting and lining power drive means comprised of hydraulic cylinder drives 17, 18 connect carrier frame 14 to machine frame 2 for vertically and laterally adjusting the carrier frame with respect to the machine frame.

A respective switch tie tamping unit 27 associated with each rail 5 is mounted between front undercarriage 3 and lifting and lining tool carrier frame 14. Each tie tamping unit comprises pairs of reciprocatory and vibratory tools 28 for tamping ballast under ties 4, the ballast tamping tools being mounted on tool carrier frame 30 which is connected to machine frame 2 by hydraulic drive 29 for immersing the tamping tools in the ballast during successive tamping cycles. Transversely extending horizontal guides 31 laterally adjustably support tamping tool carrier frames 30 on machine frame 2, and transverse adjustment drives 45 are connected to the tamping tool carrier frames for laterally adjusting the same.

According to the present invention, machine 1 further comprises branch track lifting device 21 comprising carrier frame 23, flanged rollers 22 arranged for supporting the carrier frame on one of the rails 43 of branch track 40 and laterally adjustable clamping element 20 including a pair of lifting rollers 42 arranged on carrier frame 23 for clamping engagement with the one branch track rail 43. If desired, a single clamping roller may be used. Means is provided for laterally adjusting carrier frame 23 with respect to machine frame 2 and branch track 40. In the illustrated embodiment, the means for laterally adjusting carrier frame 23 comprises laterally projecting and adjustable cantilevered arm 26 affixed to the machine frame, and lateral adjustment drive 19 connected thereto for lateral adjustment of the cantilevered arm. A vertical adjustment drive means comprising power-driven cable line 25 connects carrier frame 23 to cantilevered arm 26. Supporting the rail-bound carrier frame of the branch track lifting device on a cantilevered arm affixed to machine frame 2 provides a very sturdy and simple support structure capable of sustaining considerable lifting forces. The power-driven cable line will transmit very high tensile stresses and also enables the lifting device to be rapidly moved into its operating position.

Figure 3:
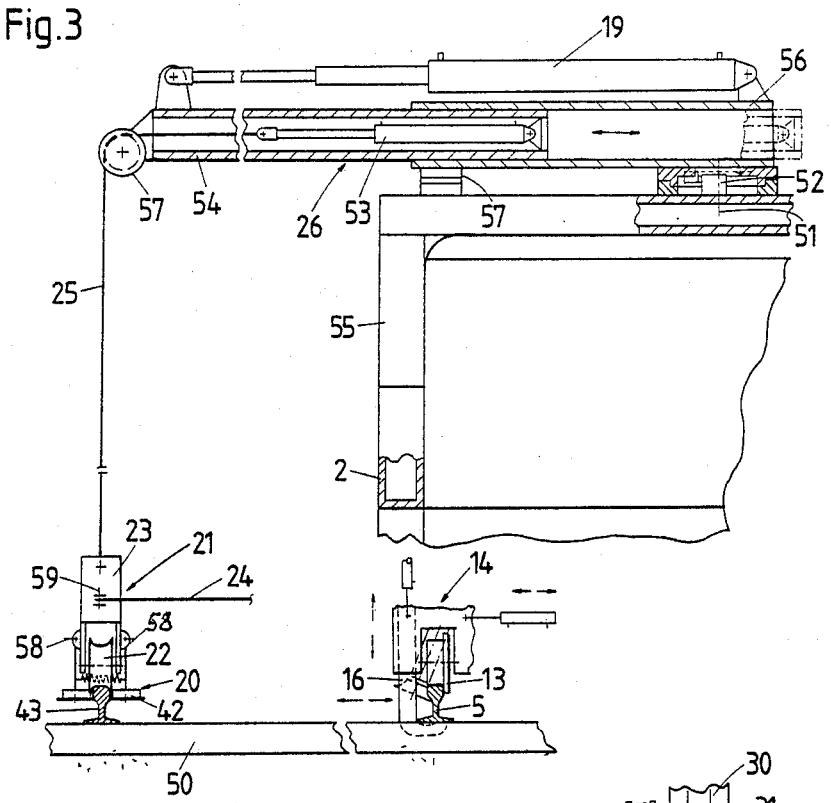
FIG. 3 is an enlarged end view, partly in section, of the branch track lifting device.

As shown in detail in FIG. 3, cantilevered arm 26 of branch track lifting device 21 is comprised of two telescoping carrier parts 54, 56 of polygonal, i.e. rectangular or square, cross section, and the means for laterally adjusting carrier frame 23 comprises drive 19 connected to the telescoping carrier arm parts for laterally adjusting the cantilevered arm so that flanged rollers 22 support carrier frame 23 on rail 43 of branch track 40. The cantilevered arm is arranged atop machine frame 2, and lateral adjustment drive 19 is a hydraulic cylinder-piston drive. Auxiliary support frame 55 is mounted atop machine frame 2 and carries carrier arm part 56 which is pivotally affixed to auxiliary support frame 55 for pivoting about vertical axis 51 through an angle of 180°, and pivoting drive 52 is connected to the arm for pivoting the same about the vertical axis. The power-driven cable line comprises cable 25 having one end connected to carrier frame 23 and an opposite end connected to drive 53 affixed to carrier arm part 54 for vertically adjusting the carrier frame, pulley 57 being affixed to carrier frame part 54 between the ends of cable 25 for guiding the cable. As shown in FIG. 2, two successive flanged rollers 22 are arranged for supporting carrier frame 23 for mobility on branch track rail 43 and a pair of lifting rollers 42 is arranged between the flanged rollers for clamping branch track rail 43 therebetween upon lateral adjustment thereof. Each lifting roller 42 is pivotal about horizontal axis 58 extending in the direction of rail 43 for pivoting the lifting rollers into clamping engagement with the branch track rail, in which operating position the lifting rollers may be held by a bolt. Connecting rod 24 links carrier frame 23 to machine frame 2, linking bolt 59 detachably connecting one end of the rod to carrier frame 23 so that rod 24 may be readily detached from the carrier frame of the branch track lifting device when machine 1 is moved between operating sites.

The telescoping lateral adjustability of cantilevered arm 26 and its mounting atop machine frame 2 enables branch track lifting device 21 readily to be moved between a rest position within the profile of main track 6 and an extended operating position for lifting the laterally adjacent branch track at a track switch. The pivotal mounting of the cantilevered support arm on the machine frame enables the same to be repositioned through 180° so that it may be used at either side of the machine, depending on the side from which the branch track branches off the main track. The arrangement of the power-driven cable line within the telescoping carrier arm parts enables the lateral and vertical adjustments to be effected without interfering with each other. Linking carrier frame 23 of the branch track lifting device by rod 24 to machine frame 2 enables branch track lifting device 21 to be advanced automatically with machine 1 without in any way interfering with the lateral adjustment of the device. If cantilevered arm 26 has a maximal lateral adjustment path corresponding in length to about the gauge of main track 6, branch track lifting device 21 will be capable of lifting the branch track up to the point where the main and branch tracks are still interconnected by common ties.

As best shown in FIG. 2, auxiliary ballast compacting device 32 at each side of machine frame 2 precedes track lifting and lining tool carrier frame 14, and a lateral adjustment drive connects the auxiliary ballast compacting device to tamping tool carrier frame 30 of respective tie tamping unit 27. This combination of an auxiliary ballast compacting device with branch track lifting device 21 enables the leveled branch track to be immediately tamped provisionally so that it is at least temporarily fixed in its leveled position. This enhances the accuracy of the corrected main track position since the portions of the long ties underlying branch track rails 43 will not sag but these long ties will, in effect, be tamped at three points.

Figure 4:
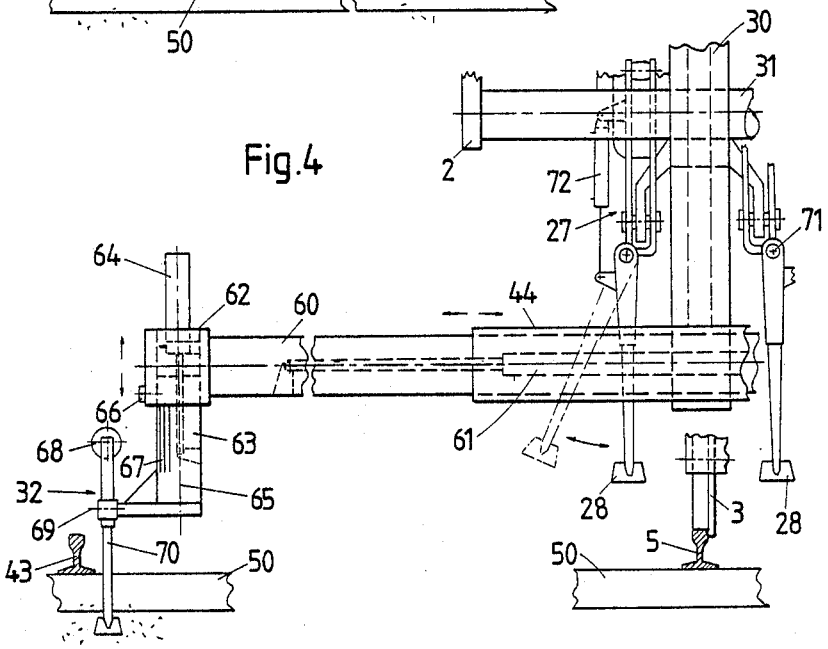
FIG. 4 is an enlarged, fragmentary cross section of the machine along line IV—IV of FIG. 2.

FIG. 4 shows a preferred embodiment of auxiliary ballast compacting device 32 affixed to tamping tool carrier 30 of tie tamping unit 27. The auxiliary ballast compacting device comprises laterally adjustable carrier 44 for the ballast compacting device, the carrier including two telescoping parts. One of the carrier parts is affixed to tamping tool carrier 30 transversely slidably mounted on horizontal guide 31 and the other carrier part 60 mounts the auxiliary ballast compacting device. Lateral adjustment drive 61 connects the telescoping carrier parts for lateral adjustment thereof. Short cylindrical guide sleeve 62 is affixed to the outer free end of long carrier part 60 and vertically adjustably receives carrier 63 of circular cross section. Vertical adjustment drive 64 connects carrier 63 to guide sleeve 62 for vertically adjusting ballast compacting device 32 on carrier part 60. Carrier 63 is rotatable in guide sleeve 62 about vertical axis 65 so that the carrier and ballast compacting device 32 affixed thereto may be rotated about this vertical axis. The guide sleeve carries a set screw 66 for engaging a selected one of axially extending grooves 67 in carrier 63. In this way, carrier 63 and ballast compacting device 32 may be fixed in selected positions upon rotation of the carrier in the guide sleeve without interfering with the vertical adjustability of the ballast compacting device by drive 64. The auxiliary ballast compacting device has a lateral adjustment path of a length corresponding at least to the lateral adjustment path of branch track lifting device 21. The illustrated ballast compacting device comprises two reciprocatory tamping tools 70 which are reciprocal about transversely extending axis 69 by reciprocating drive 68. The telescoping lateral adjustability of the auxiliary ballast compacting device enables the device to be accurately adjusted to the path of the branch track rail leveled by branch track lifting device 21. The reciprocatory tamping tools will effectively tamp ballast under the leveled ties.

As shown in FIGS. 1 and 2, mobile machine 1 further comprises vertically adjustable machine frame support 35 affixed to machine frame 2 at each side thereof adjacent front undercarriage 3. Each machine frame support is telescopingly laterally adjustable by drive 34 for extension towards branch track 40 and comprises two double-flanged support rollers 36 for engagement with inner branch track rail 43. The double-flanged support rollers are affixed to carrier frame 46 which is rotatably connected to vertically adjustable carrier 47 for rotating about a vertical axis. Carrier 47 is vertically adjustably mounted in a transversely displaceable carrier 48 which, in turn, is telescopingly received in carrier sleeve 49 affixed to machine frame 2 and receiving transverse displacement drive 34. A like support 35 at the opposite side of machine frame 2 can be used for operation on a branch track branching off the main track at that machine frame side. Vertical adjustment drive 33 enables the support rollers to be vertically adjusted into and out of engagement with the branch track rail. This support arrangement will effectively counteract any one-sided torsion moment transmitted by branch track lifting device 21 to machine frame 2. Support of the machine frame on the branch track rail will provide a secure and unyielding bearing for the machine frame and its location at the front undercarriage prevents any interference with the track switch lifting behind the support. If machine frame support 35 has a lateral adjustment path of a length corresponding at least to the lateral adjustment path of branch track lifting device 21, it may be effectively used at the farther reaches of the branch track where the torsion moments are greatest so that machine frame 2 will be effectively supported during the entire switch leveling, lining and tamping operation.

Furthermore, the machine comprises a pair of shock-absorbing support cylinders 38 at each side of each undercarriage 3, each pair of support cylinders constituting a support 37 of machine frame 2 on the undercarriages, and each support cylinder 38 having opposite ends respectively linked to machine frame 2 and to undercarriage 3. These supports provide a simple structure for eliminating movement of the machine frame on the undercarriages and will hold the machine frame in a fixed position thereto to avoid any leaning of the machine frame towards the side on which branch track lifting device 21 operates.

The machine carries conventional track leveling and lining reference system 39 for controlling the operation of the leveling and lining tools.

As shown in FIG. 4, tamping tools 28 of switch tamping unit 27 are each pivotal about horizontal axis 71 extending in the direction of main track rails 5 for adjustment between an operating position shown in full lines and an inoperative position shown in chain-dotted lines so that respective tamping tools may be moved out of the way of obstacles encountered in the switch. Independently operating pivoting drives 72 are connected to the tamping tools for selectively pivoting the same. This makes it possible to use the tamping unit in difficult switch areas, for example where a frog would prevent a tamping tool from being immersed in the ballast upon vertical adjustment of tamping tool carrier 30. By transversely displacing the tamping tool carrier along guides 31, tamping tools 28 may be suitably centered.

The operation of mobile machine 1 will partly be obvious from the preceding description of a preferred embodiment and will now be explained in detail:

Upon reaching a switch where branch track 40 branches off main track 6, cantilevered arm 26 is laterally extended from its rest position shown in chain-dotted lines in FIG. 2 to the operative position shown in full lines in this figure. The free end of cable 25 is then connected with carrier frame 23 of branch track lifting device 21 and connecting bolt 59 is attached to carrier frame 23 so that rod 24 links the branch track lifting device to machine frame 2. Transverse displacement drive 19 is actuated to extend carrier arm part 54 with carrier frame 23 laterally until lifting rollers 42 are in alignment with branch track rail 43 (see FIG. 2). Vertical displacement drive 53 is then actuated until flanged rollers 22 are lowered into engagement with rail 43. Clamping rollers 42 are then pivoted into clamping engagement with rail 43 and held in their clamping position by a bolt inserted to hold them in a fixed position. Transverse and vertical displacement drives 61 and 64 are actuated until tamping tools 70 of auxiliary ballast compacting device 32 are properly positioned laterally adjacent rail 43 into the position shown in FIGS. 2 and 4. Vertical and transverse displacement drives 33 and 33 are actuated until double-flanged support rollers 36 of machine frame support 35 are in engagement with the other rail 43 of branch track 40, as shown in FIG. 2. Instead of this machine frame support or in addition thereto, support cylinders 38 of machine frame support 37 may be actuated to hold machine frame 2 fixed against the one-sided torsion forces exerted thereupon by branch track lifting device 21.

After clamping rollers 15 of the main track lifting and lining device have been pivoted into clamping engagement with main track rails 5, main track 6 is leveled and lined under the control of leveling and lining system 39. The switch lifting operation is effected by lifting drives 17 and 53 whereby main track 6 and branch track 40 are equally leveled. Any lining errors are corrected by operation of lining drive 18 which transversely displaces the main track with the branch track. While the switch is in its raised position, long ties 50 connecting the main and branch tracks are tamped by tamping tools 28 and 70 immersed in the ballast and reciprocated to tamp ballast under the ties. If desired, ballast may also be tamped under ties 50 at the field side of branch track rail 43 by raising tamping tools 70 out of the ballast at the gage side of rail 43 by operation of drive 64, displacing the tamping tools transversely to the field side of the rail by operation of drive 61, and then again immersing the tamping tools in the ballast at the field side by operation of drive 64. After completion of the tamping cycle and raising all the tamping tools out of the ballast, machine 1 is advanced to the next tie 50 where the leveling, lining and tamping operation is repeated. As required and shown in FIG. 2, tamping tools 70 of auxiliary ballast compacting device 32 may be oriented parallel to branch track rail 43 by loosening set screw 66 momentarily, rotating carrier 63 about axis 65 and then tightening the set screw in engagement with a respective groove 67 so that the tamping tools are retained in their properly oriented position.

After the switch has been properly positioned and fixed in the leveled and lined position, branch track lifting device 21, auxiliary ballast compacting device 32 and machine frame support 35 are laterally retracted into their inoperative positions on machine frame 2, with retracted arm 26 of branch track lifting device 21 pivoted about vertical axis 51 to extend parallel to machine frame 2 between the sides thereof, and surfacing of main track 6 is continued in a conventional manner with the main track lifting and lining unit and tamping units 27. If machine 1 advancing along main track 6 encounters another switch where a branch track branches off at a side opposite to that shown in FIG. 2, for example, cantilevered arm 26 is pivoted about vertical axis 51 to project to the opposite side and auxiliary ballast compacting device 32 and machine frame support 35 at the opposite side are used.

What is claimed is:

1. A mobile machine for leveling, lining and tamping a track switch comprising a main track and a branch track laterally adjacent the main track resting on ballast, each track consisting of two rails fastened to successive ties, which comprises (a) a machine frame supported on undercarriages for movement along the main track in an operating direction, (b) a track lifting and lining tool carrier frame mounting (1) lining tools including a pair of flanged lining rollers arranged for supporting the carrier frame on the rails of the main track and for lining engagement with the main track rails, and (2) lifting tools including a respective vertically and laterally adjustable clamping element arranged for clamping engagement with the main track rails, (c) lifting and lining power drive means connecting the carrier frame to the machine frame for vertically and laterally adjusting the carrier frame with respect to the machine frame, (d) a branch track lifting device comprising (1) a carrier frame, (2) flanged rollers arranged for supporting the carrier frame on one of the rails of the branch track, and (3) a laterally adjustable clamping element including at least one lifting roller arranged on the carrier frame for clamping engagement with the one branch track rail, and (e) means for laterally adjusting the branch track lifting device carrier frame with respect to the machine frame and the branch track.

2. The mobile machine of claim 1, wherein the means for laterally adjusting the carrier frame of the branch track lifting device comprises a laterally projecting and adjustable cantilevered arm affixed to the machine frame, and a vertical adjustment drive means connecting the carrier frame to the cantilevered arm for lifting the laterally adjustable clamping element with the one branch track rail clamped thereto.

3. The mobile machine of claim 2, wherein the vertical adjustment drive means comprises a power-driven cable line connecting the carrier frame to the cantilevered arm.

4. The mobile machine of claim 3, wherein the cantilevered arm is comprised of two telescoping carrier parts of polygonal cross section, the means for laterally adjusting the carrier frame comprising a drive connected to the telescoping carrier arm parts for laterally adjusting the cantilevered arm, and the power-driven cable line comprising a drive affixed to one of the carrier arm parts and connected to the cable for vertically adjusting the carrier frame.

5. The mobile machine of claim 3, wherein two successive ones of said flanged rollers are arranged for supporting the carrier frame for mobility on the one branch track rail and a pair of said lifting rollers is arranged between the flanged rollers for clamping the one branch track rail therebetween upon lateral adjustment thereof, and further comprising a connecting rod linking the carrier frame to the machine frame.

6. The mobile machine of claim 2, wherein the cantilevered arm is arranged atop the machine frame and has two telescoping parts, the means for laterally adjusting the carrier frame comprising a hydraulic cylinder-piston drive connected to the telescoping arm parts for laterally adjusting the cantilevered arm.

7. The mobile machine of claim 2, wherein the cantilevered arm is pivotally affixed to the machine frame for pivoting about a vertical axis, and further comprising a pivoting drive connected to the arm for pivoting the same about the vertical axis.

8. The mobile machine of claim 2, wherein the cantilevered arm has a maximal lateral adjustment path corresponding in length to about the gauge of the main track.

9. The mobile machine of claim 1, further comprising a respective tie tamping unit associated with each main track rail and comprising a tamping tool carrier frame, an auxiliary ballast compacting device at each side of the machine frame and preceding the track lifting and lining tool carrier frame, and a lateral adjustment drive connecting the auxiliary ballast compacting device to the tamping tool carrier frame of a respective tie tamping unit.

10. The mobile machine of claim 9, further comprising transversely extending guide means laterally adjustably supporting the tamping tool carrier frames of the tie tamping units on the machine frame.

11. The mobile machine of claim 9, further comprising a laterally adjustable carrier for the ballast compacting device, the carrier including two telescoping parts, one of the carrier parts being affixed to the tamping tool carrier frame and the other carrier part mounting the ballast compacting device, the lateral adjustment drive connecting the telescoping carrier parts for lateral adjustment thereof, and a vertical adjustment drive for vertically adjusting the ballast compacting device on the other carrier part, the ballast compacting device having a lateral adjustment path of a length corresponding at least to the lateral adjustment path of the branch track lifting device.

12. The mobile machine of claim 11, wherein the auxiliary ballast compacting device comprises reciprocatory tamping tools for tamping ballast under adjacent ones of the ties.

13. The mobile machine of claim 1, further comprising a vertically adjustable machine frame support affixed to the machine frame adjacent one of the undercarriages, the machine frame support being telescopingly laterally adjustable for extension towards the branch track and comprising at least one double-flanged support roller for engagement with a respective one of the branch track rails.

14. The mobile machine of claim 13, wherein the laterally adjustable machine frame support has a lateral adjustment path of a length corresponding at least to the lateral adjustment path of the branch track lifting device.

15. The mobile machine of claim 1, further comprising a pair of shock-absorbing support cylinders at each side of each undercarriage, each pair of support cylinders constituting a support of the machine frame on the undercarriages, and each support cylinder having opposite ends respectively linked to the machine frame and to the undercarriage.

* * * * *